United States Patent [19]

Brantley, Jr.

[11] 4,085,917

[45] Apr. 25, 1978

[54] PICTURE HANGER

[76] Inventor: Haskew H. Brantley, Jr., 6114 Riverside Dr. NW., Atlanta, Ga. 30328

[21] Appl. No.: 697,875

[22] Filed: Jun. 21, 1976

Related U.S. Application Data

[63] Continuation-in-part of Ser. No. 599,928, Jul. 29, 1975.

[51] Int. Cl.[2] ..... A47G 1/24

[52] U.S. Cl. ..... 248/489; 248/218.3

[58] Field of Search ..... 248/219, 220, 302, 303, 248/497, 498, 499, 309 A, 218.3

[56] References Cited

U.S. PATENT DOCUMENTS

| | | | |
|---|---|---|---|
| 505,209 | 9/1893 | White | 248/220 |
| 770,163 | 9/1904 | Cobb | 248/220 |
| 1,034,886 | 8/1912 | Dehn | 248/489 X |
| 1,583,391 | 5/1926 | Cook | 248/302 |
| 1,614,349 | 1/1927 | Daley | 248/303 |
| 2,448,137 | 8/1948 | Cody | 248/497 |

FOREIGN PATENT DOCUMENTS

| | | | |
|---|---|---|---|
| 467,821 | 9/1950 | Canada | 248/489 |
| 362,899 | 11/1922 | Germany | 248/498 |

*Primary Examiner*—William H. Schultz

*Attorney, Agent, or Firm*—Newton, Hopkins & Ormsby

[57] ABSTRACT

A picture hanger formed essentially from a section of wire has a center nail receiving eye or sleeve and a pair of frame suspension points spaced widely and equidistantly from the axis of said eye or sleeve. The device facilitates the delicate balancing of framed pictures and mirrors on a wall without the use of frame attached wires.

9 Claims, 17 Drawing Figures

PICTURE HANGER

CROSS-REFERENCE TO RELATED APPLICATION

This is a continuation-in-part of application Ser. Number 599,928, filed July 29, 1975.

BACKGROUND OF THE INVENTION

There is an ever-present need for an improved, simplified and more economical means to hang pictures, mirrors and other framed art on walls in the home and elsewhere. The increased appreciation of art in the home in recent times has stimulated the need for improved picture hangers.

It is therefore the object of this invention to satisfy the above need and to provide a highly effective hanger for framed pictures and the like which is more stable during use than conventional hangers and which dispenses with the necessity for drilling holes or mounting eye screws in the backs of costly and delicate picture frames which are sometimes damaged by such conventional means. The invention also eliminates the need for picture hanging wires which are awkward to install and sometimes unsafe if inadequately tied or twisted.

The present invention also renders the hanging of the pictures and mirrors more convenient and less costly, and once properly installed by means of the invention, there is a lesser tendency for the hung picture to shift from its level attitude. The use of the invention requires no damaging or marring of the picture frame and avoids a common problem occasioned when the wood of the frame is so hard and brittle from aging that it is almost impossible to insert a screw or nail into it without damaging or splitting the wood.

Other features and advantages of the invention will become apparent during the course of the following description.

DETAILED DESCRIPTION

Figure 1:
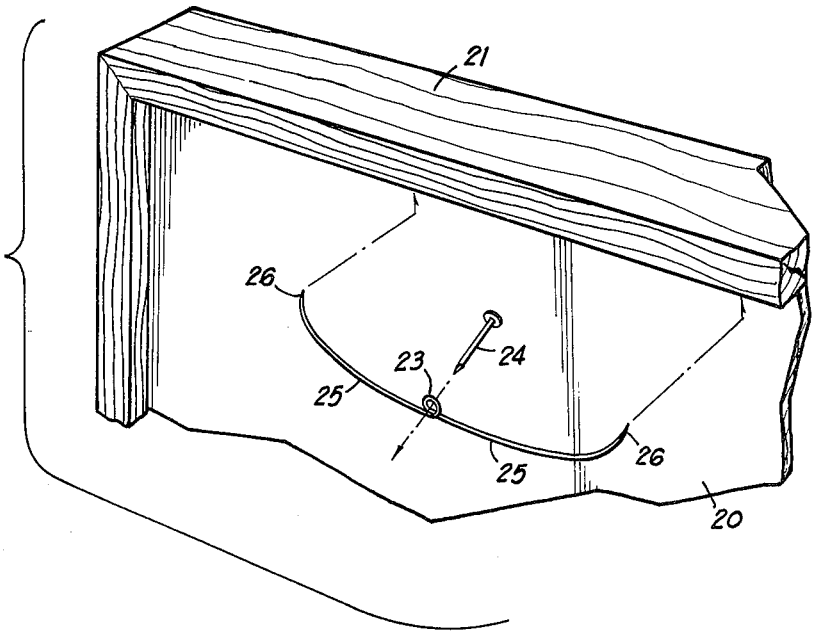
FIG. 1 is an exploded perspective view of a picture hanger, mounting nail and framed picture according to one embodiment of the invention.
Figure 2:
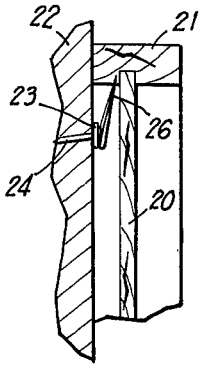
FIG. 2 is a fragmentary vertical section taken through a wall-mounted picture utilizing the hanger in FIG. 1.

Referring to the drawings in detail wherein like numerals designate like parts, the numeral 20 designates a picture, mirror or the like having a supporting frame 21 for mounting or hanging on a vertical wall 22. As shown in FIGS. 1 and 2, a picture hanger is formed from a unitary wire section shaped to provide a center eye or loop 23 adapted to receive a supporting nail 24 or like fastener which is driven into the wall 22 on a suitable angle, FIG. 2. A pair of equal length slightly curved support arms 25 extend from opposite sides of the eye 23 and terminate in upturned frame suspension elements 26 which are preferably pointed. As shown in FIG. 2, when the hanger is secured to the wall by the nail 24 and the eye or loop 23 is abutting the wall, the upturned elements 26 are spaced from the vertical wall and diverge therefrom upwardly so as to be engageable with the top horizontal member of the picture frame forwardly of the wall.

It is merely necessary to rest the top of the frame 21 on the two points 26 and to seek a proper balance of the picture relative to the supporting nail 24. The prongs or points or elements 26 tend to cam the picture frame 21 inwardly to a position flat against the wall 22 when the frame 21 is urged downwardly and the prongs 26 penetrate the inner surface of the frame 21, as shown in FIG. 2. The wide spacing between the elements 26 promotes balancing and renders the support of the picture very stable. Frictional contact of the rather long arms 25 with the wall surface tends to prevent shifting of the hung and balanced picture or mirror. There is no necessity for applying eye screws, nails and/or suspension wires to the picture frame 21 which may be a costly frame.

Figure 3:
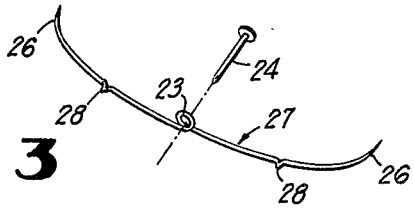
FIG. 3 is a perspective view of a hanger according to a second embodiment.
Figure 4:
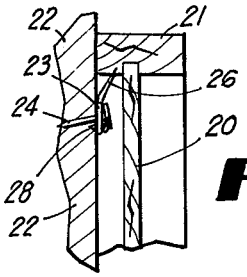
FIG. 4 is a fragmentary vertical section similar to FIG. 2 showing the use of the hanger in FIG. 3.

In FIGS. 3 and 4, a slightly modified hanger 27 is depicted which is constructed in the same manner as the previously-described hanger but with the addition on the two support arms near their longitudinal centers of small friction points 28 or barbs which face the vertical wall surface and tend to penetrate it, FIG. 4, to further resist swinging or rotation of the hanger around the axis of the nail 24 after the supported picture has been properly balanced on the hanger 27.

Figure 5:
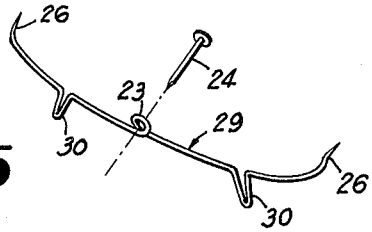
FIG. 5 is a perspective view of a hanger according to a third embodiment of the invention.
Figure 6:
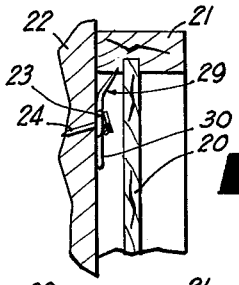
FIG. 6 is a fragmentary cross sectional view showing the third embodiment.

FIGS. 5 and 6 show a further modified hanger 29 still basically similar to the hangers in FIGS. 1 and 3, but wherein the two support arms are shaped near their longitudinal centers to form a pair of equally sized symmetrically arranged depending V-shaped friction elements 30 which during the use of the hanger, FIG. 6, lie flat against the wall 22 to create friction with the wall and thereby resist rotation around the axis of the nail.

Figure 7:
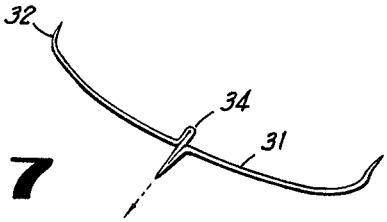
FIGS 7–8, 9, 10–11, 12–13, 14–15 and 16–17 are similar companion views showing additional embodiments of the invention.
Figure 8:
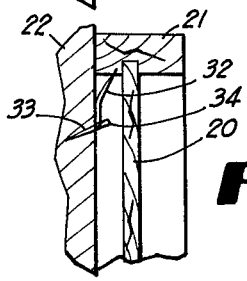

FIGS. 7 and 8 show another modification of the basic picture hanger described in the prior embodiments but differing therefrom by the absense of the eye or loop 23. Instead of this eye or loop, a wire hanger 31 having frame suspension points 32 is provided at its center with an integral pointed prong 33 or "nail" having a forwardly projecting "head" 34 to facilitate driving into the wall 22. Preferably, as shown in FIG. 8, the prong 33 is arranged at an angle to the wall when the elements 32 are against the wall and upright, as in FIG. 8. The hanger depicted in FIGS. 7 and 8 possesses the same basic advantages described for the original embodiment, FIGS. 1 and 2.

Figure 9:
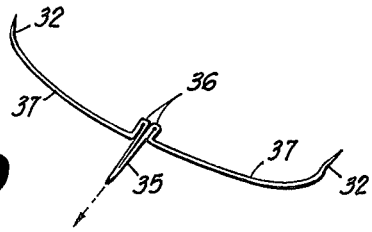

FIG. 9 depicts a slight modification of the hanger shown in FIG. 7 and differs therefrom only in that the wall-penetrating prong 35 at the center of the hanger is symmetrical and has a driving head formed by two companion loops 36 formed from the wire of the hanger forwardly of the support arms 37 instead of the single loop head shown in FIG. 7.

Figure 11:
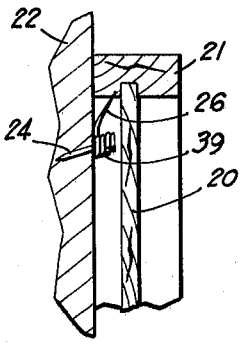
Figure 10:
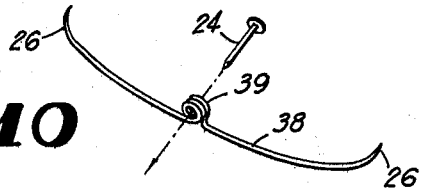

FIGS. 10 and 11 show another embodiment of the invention in which the wire hanger 38 is constructed similarly to the previously-described hangers but with a center nail-receiving sleeve 39 being provided by two or more coils of wire and the axis of this sleeve 39 set at an angle to the wall 22 to receive the nail 24 at a corresponding angle, as in FIG. 11.

Figure 12:
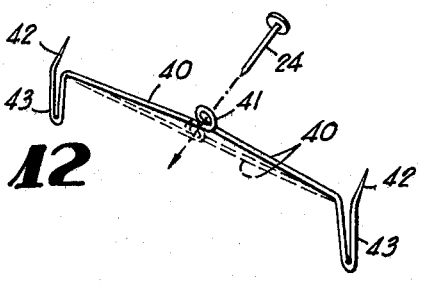
Figure 13:
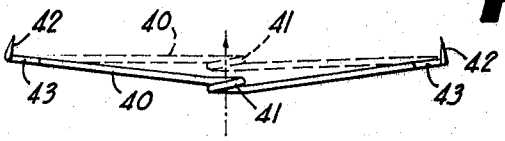

FIGS. 12 and 13 depict still another embodiment of the invention wherein a wire hanger has a pair of straight support arms 40 extending equidistantly on opposite sides of a nail-receiving eye 41 and terminating in a pair of upwardly directed frame suspension points 42, below which extend a pair of approximately V-shaped wall-engaging friction elements 43. As shown in FIG. 13, the arms 40 are tensioned so that a hanger is slightly bowed prior to installation. However, when the nail 24 is driven, the hanger is deformed to the broken line position against the wall and this increases the stability of the hanger.

Figure 15:
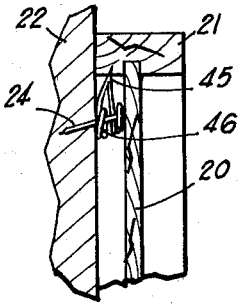
Figure 14:
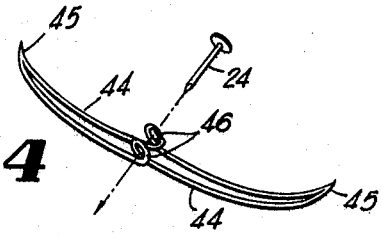

FIGS. 14 and 15 show another variant of the invention wherein the same general type of hanger formed of wire has its support arms 44 formed by paired sections of wire which are joined at their outer ends to form frame suspension points 45. Twin coaxial spaced nail-receiving eyes 46 are formed at the center of the hanger, as shown in the drawings.

Figure 17:
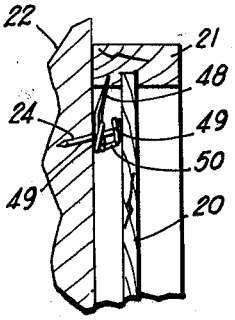
Figure 16:
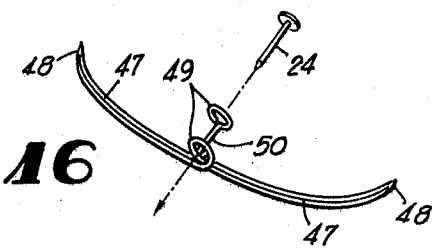

FIGS. 16 and 17 show a final embodiment of the invention wherein the hanger has double strand contacting arms 47 terminating in points 48 and axially spaced nail-receiving eyes 49 at its center, said eyes being joined by a lower extension or arm 50, extending between the two eyes 49 and said extension 50 integral with one arm 47.

All disclosed forms of the invention basically provide a picture hanger whose upstanding frame suspension points are widely spaced equidistantly from a center eye or sleeve which receives a mounting nail or other fastener. The arms of the hanger with or without added points or projections frictionally engage the wall to resist pivoting movement of the hanger after installation. In some forms, the nail or fastener is integral with the hanger.

It is to be understood that the forms of the invention herewith shown and described are to be taken as preferred examples of the same, and that various changes in the shape, size and arrangement of parts may be resorted to, without departing from the spirit of the invention or scope of the subjoined claims.

What is claimed is:

1. A hanger for pictures and the like comprising an elongated wire body having diverging arms for engaging the wall throughout substantial portions of their lengths and upstanding suspension elements on the ends of said arms on which a picture frame may rest, and means between said arms on the body portion substantially midway between said suspension elements and including a closed loop element substantially at its longitudinal center for anchoring the hanger to a wall or the like, the upper ends of said suspension elements terminating above said loop element so that said picture frame may be flat against the wall when supported by said elements.

2. A hanger as defined in claim 1 wherein said loop is formed integrally with said body portion.

3. A hanger as claimed in claim 1 wherein said loop element includes plural spaced coaxial coils constituting a sleeve and said hanger includes a nail received through said sleeve.

4. A picture hanger comprising an elongated wire having a central portion extending substantially vertically in a plane and having centrally located closed wire loop means for attaching said wire to a vertical wall with said central portion abutting the wall and a pair of spaced, upstanding, complementary prongs integral with said central portion projecting upwardly, outwardly and forwardly from said central portion away from the wall for receiving spaced portions of the inner surface of a picture frame so as to cam the picture frame inwardly to a position flat against the wall when said frame is urged downwardly and said prongs penetrate said inner surface.

5. A picture hanger as claimed in claim 4 wherein said centrally located means includes an integral closed loop in said wire in said plane and said hanger further comprises a nail received in said loop extending backwardly and downwardly therefrom, said loop encircling said nail.

6. A picture hanger as claimed in claim 4 wherein said centrally located means includes a plurality of complete loops forming a sleeve for said nail.

7. A picture hanger as claimed in claim 4 further comprising downwardly extending elements integrally formed in said wire intermediate said prongs and said centrally located means extending within said plane.

8. A picture hanger as claimed in claim 4 wherein said central portion includes a rear portion extending between said prongs in said plane and a forward portion extending between said prongs forwardly of said plane and said centrally located means includes aligned spaced loops in said rear portion and said forward portion.

9. A picture hanger as claimed in claim 4 wherein said central portion further includes a barb integrally formed in said wire and extending rearwardly from said plane for engaging the wall and preventing rotation of said wire about said centrally located means.

* * * * *